United States Patent [19]

Boland et al.

[11] Patent Number: 4,756,579

[45] **Date of Patent: * Jul. 12, 1988**

[54] BRUSH FILLING METHOD AND FILLED BRUSHES

[75] Inventors: Anthony C. Boland, San Marino; George R. Maxwell, Altadena, both of Calif.

[73] Assignee: L.A. Brush Manufacturing Corp., Los Angeles, Calif.

[ * ] Notice: The portion of the term of this patent subsequent to May 26, 2004 has been disclaimed.

[21] Appl. No.: 942,368

[22] Filed: Dec. 15, 1986

Related U.S. Application Data

[63] Continuation of Ser. No. 716,985, Mar. 28, 1985, abandoned, which is a continuation-in-part of Ser. No. 682,552, Dec. 17, 1984, abandoned.

[51] Int. Cl.[4] ..... A46D 1/00

[52] U.S. Cl. ..... 300/21; 29/430

[58] Field of Search ..... 29/429, 430, 431, 791, 29/792, 822, 564.1, 564.2, 564.7, 564.8, 566, 566.1, 33 K, 33 J; 300/21, 2, 3, 4, 5, 10, 11

[56] References Cited

U.S. PATENT DOCUMENTS

| | | | |
|---|---|---|---|
| 1,125,136 | 1/1915 | Liebig | 300/3 X |
| 1,318,416 | 10/1919 | Stabler et al. | 29/566 |
| 2,007,698 | 7/1935 | Tear | 29/33 J |
| 2,031,658 | 2/1936 | Jones | 300/3 |
| 2,223,681 | 12/1940 | Fisher | 300/3 |
| 2,953,069 | 9/1960 | Smith | 29/33 J |
| 3,339,983 | 9/1967 | Maxner et al. | 300/3 |
| 4,668,019 | 5/1987 | Boland et al. | 300/3 |

FOREIGN PATENT DOCUMENTS

| | | | |
|---|---|---|---|
| 1089360 | 9/1960 | Fed. Rep. of Germany | 300/3 |

*Primary Examiner*—P. W. Echols
*Assistant Examiner*—Joseph M. Gorski
*Attorney, Agent, or Firm*—William W. Haefliger

[57] ABSTRACT

A brush filling process employs longitudinally axially spaced rotary heads, and a core and includes the steps:

(a) releasably coupling three of the brush cores to two of the heads, with the cores spaced about the axis, (b) rotating at least one of the heads about the axis, to rotate the cores between three index positions, (c) forming bristle receiving holes in a core at one of the positions, (d) filling bristles into the holes at a second of the positions, and (e) trimming the filled bristles at a third of the positions.

34 Claims, 13 Drawing Sheets

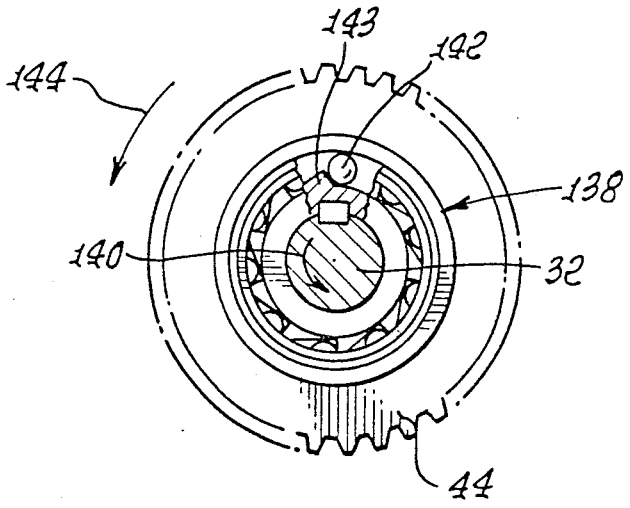
FIG. 7.
FIG. 5.
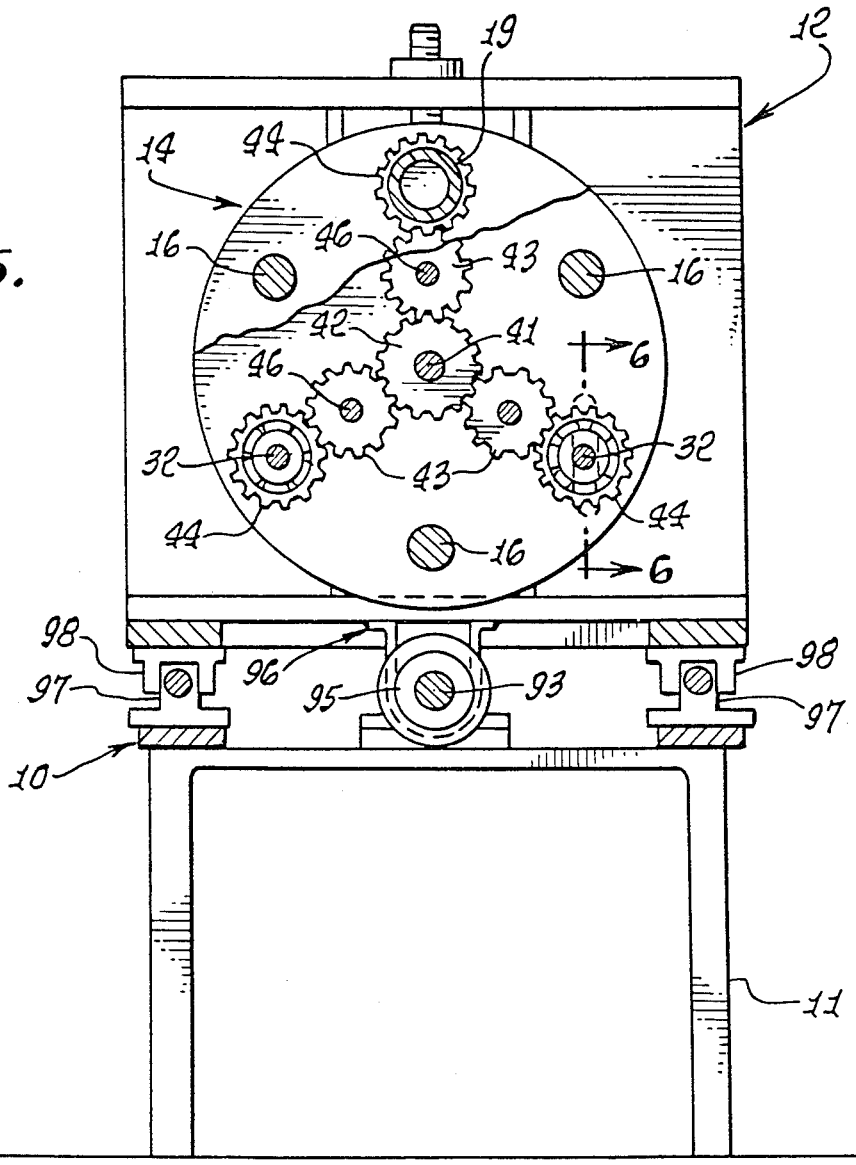

BRUSH FILLING METHOD AND FILLED BRUSHES

This is a continuation of application Ser. No. 716,985 filed Mar. 28, 1985, now abandoned, which is a continuation-in-part of application Ser. No. 682,552, filed Dec. 17, 1984, now abandoned.

BACKGROUND OF THE INVENTION

This invention relates generaly to brush making, and more specifically to an automatic process for filling bristles into elongated cores.

There is a continuing demand for rotary brushes especially of large size, of various diameters, and axial lengths, bristle concentrations per unit brush area, and bristle lengths. Along with this demand, there is need for an efficient, easily performed process to produce such brushes, of selected and different bristle configurations, as for example have cores of considerable lengths—6–12 feet for example. Also, there is need for high quality brushes, of selectable bristle configurations, produced as by such process.

SUMMARY OF THE INVENTION

It is a major object of the invention to provide a process for selectively, rapidly and controllably filling bristles into brush cores. Basically, such process employs longitudinally axially spaced rotary heads, and a core, and comprises the steps:

(a) releasably coupling three of said brush cores to two of the heads, with the cores spaced about the axis, (b) rotating at least one of the heads about said axis, to rotate the cores between three index positions, (c) forming bristle receiving holes in a core at one of said positions, (d) filling bristles into the holes at a second of said positions, and (e) trimming the filled bristles at a third of said positions.

It is a further object of the invention to provide for supporting the rotary heads and carrying out the above steps to allow relative axial movement of such rotary heads, whereby cores of different lengths can be supported for filling. To this end, the heads may typically include first and second heads interconnected by elongated rods, and an auxiliary head supported on said rods, between said first and second heads. As will be seen, the auxiliary head may be movable lengthwise on rods and relative to the first and second heads, to accomodate connection of different length cores to the first and auxiliary heads, via couplings.

It is another object of the invention to facilitate selection of filled bristle length through provision of process for effecting relative lateral movement (vertical, for example) between the rotary heads to which the cores are attached, and means for filling bristles into core holes. As will be seen, jack screws may be associated with heads between which elongated connecting rods extend, for elevating and lowering such heads and rods relative to means which fills bristles substantially vertically into core holes in the second position.

Formation of the holes at selected axially spaced positions in the core is effected by the provision of an axially longitudinally extending screw operatively connected with at least one of said frame members for controllably shifting the frame members axially.

It is a yet further object to simultaneously rotate the cores at said second and third positions, and relative to the heads, whereby holes may be selectively drilled at angularly spaced locations, and bristles may be filled into the holes. Also, the process involves independently continuously rotating the core in its third (bristles trimming) position.

These and other objects and advantages of the invention, as well as the details of an illustrative embodiment, will be more fully understood from the following specification and drawings, in which:

DRAWING DESCRIPTION

FIGS. 1*a* and 1*b* are plan view of apparatus embodying the invention, and specifically left and right portions respectively of that apparatus;

FIGS. 2*a* and 2*b* are elevations of the FIGS. 1*a* and 1*b* apparatus, and taken on lines 2—2 of FIGS. 1*a* and 1*b;*

FIG. 5 is an enlarged section taken in section on lines 5—5 of FIG. 3;

FIG. 7 is a section on lines 7—7 of FIG. 6;

DETAILED DESCRIPTION

General

Figure 1A:
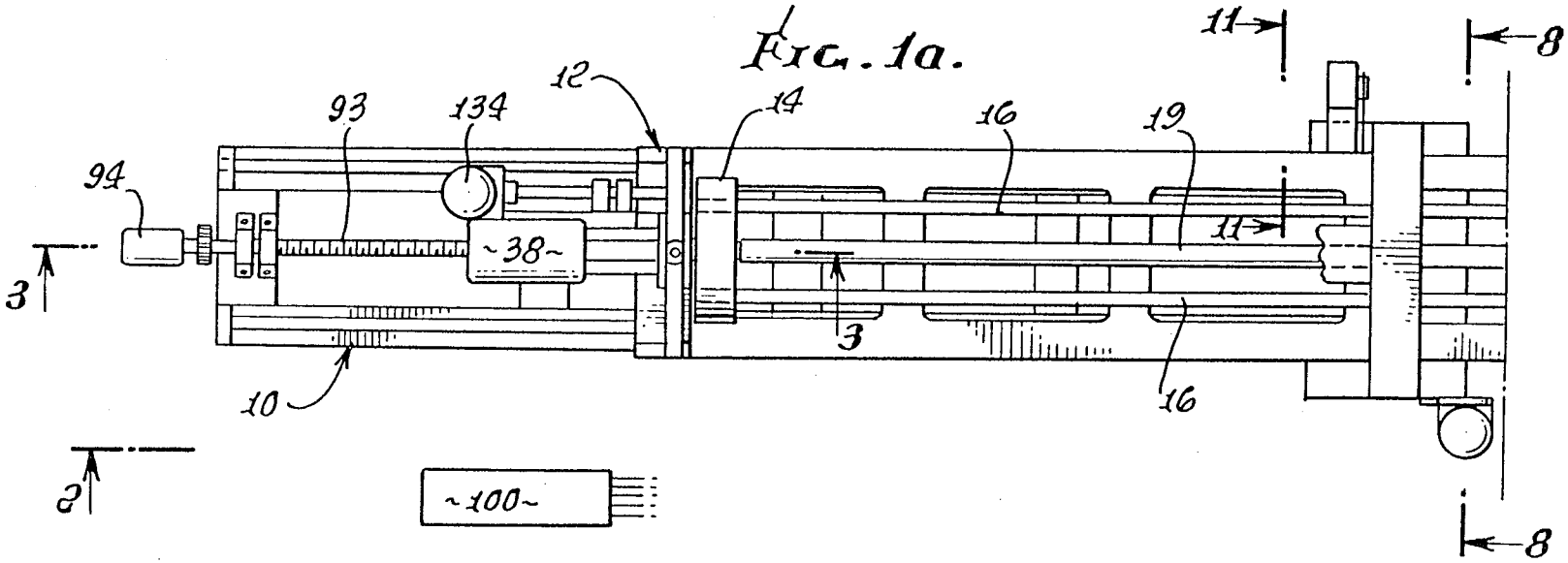
Figure 1B:
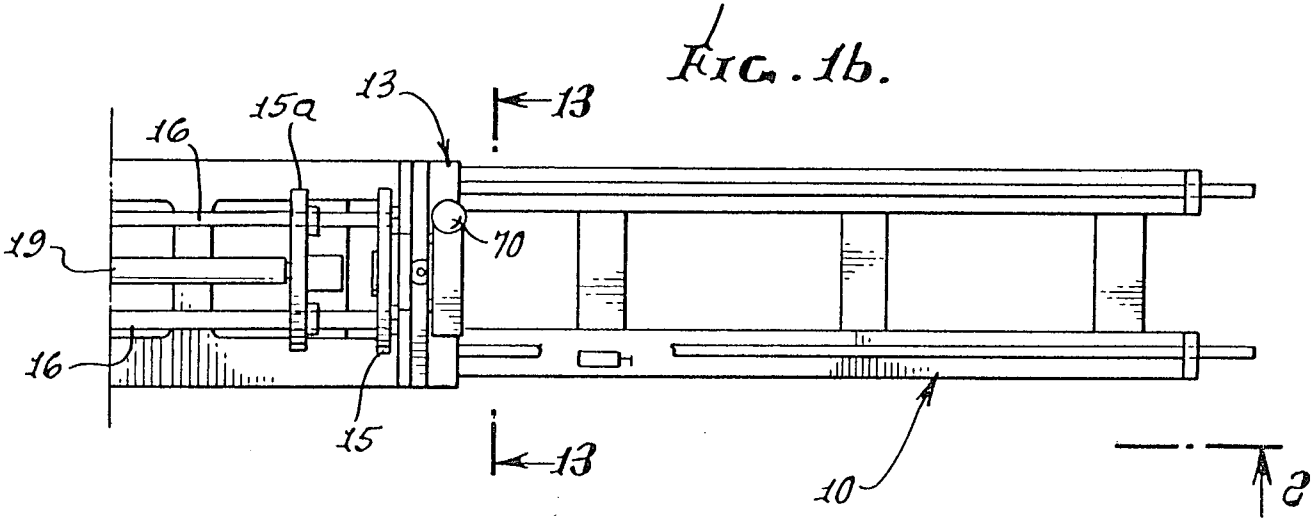
Figure 2A:
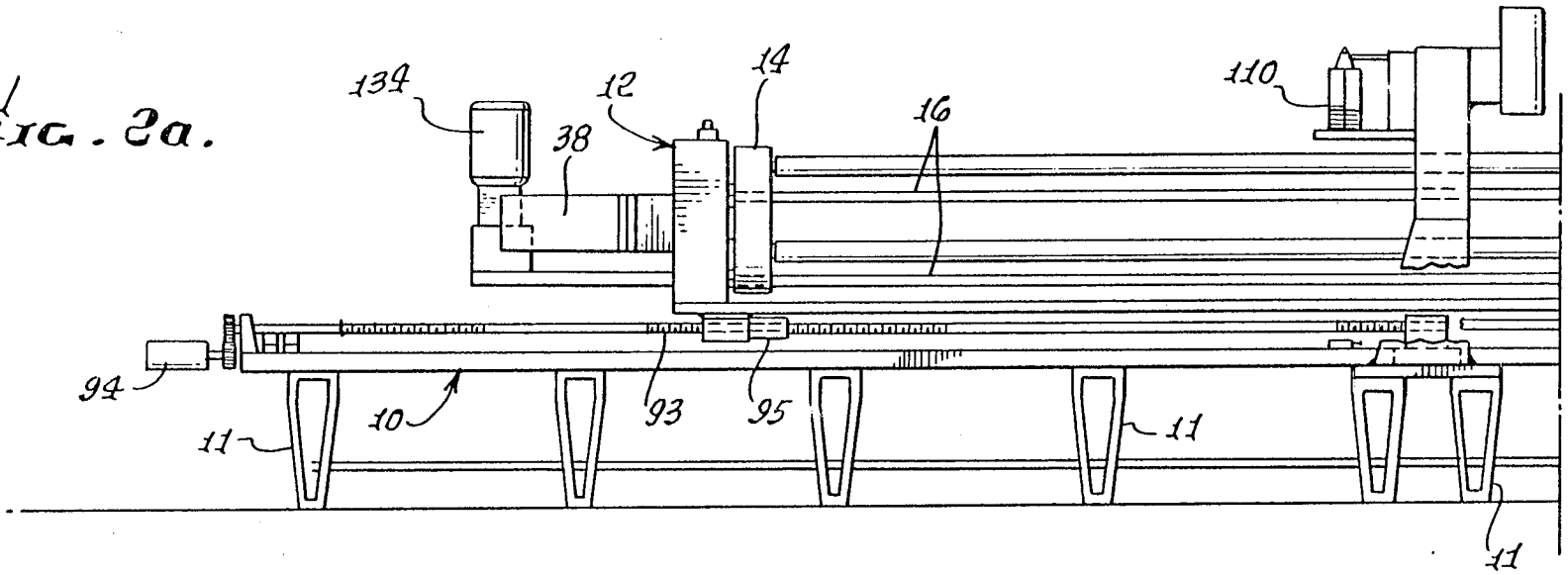
Figure 2B:
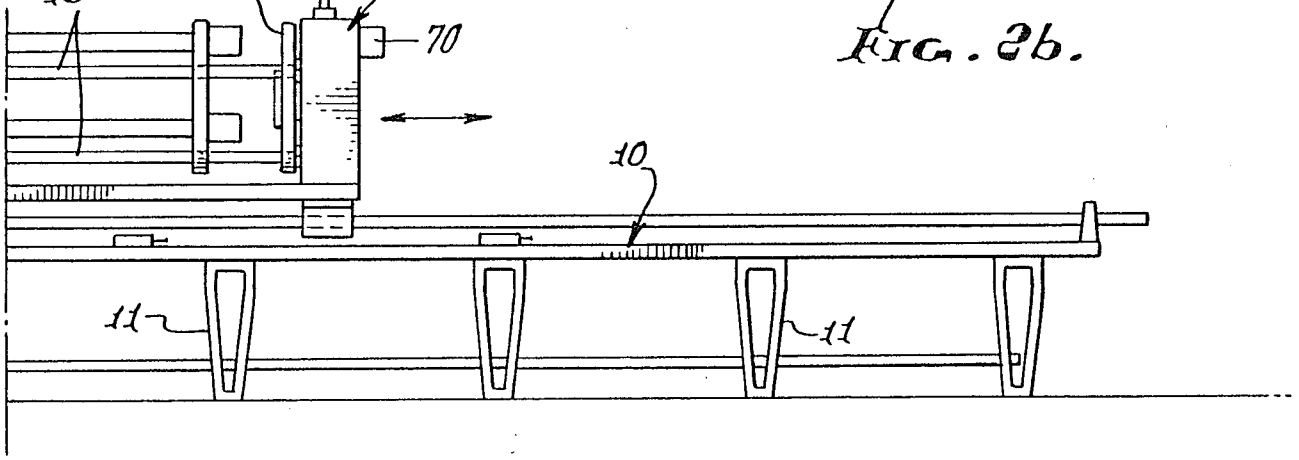
Figure 3:
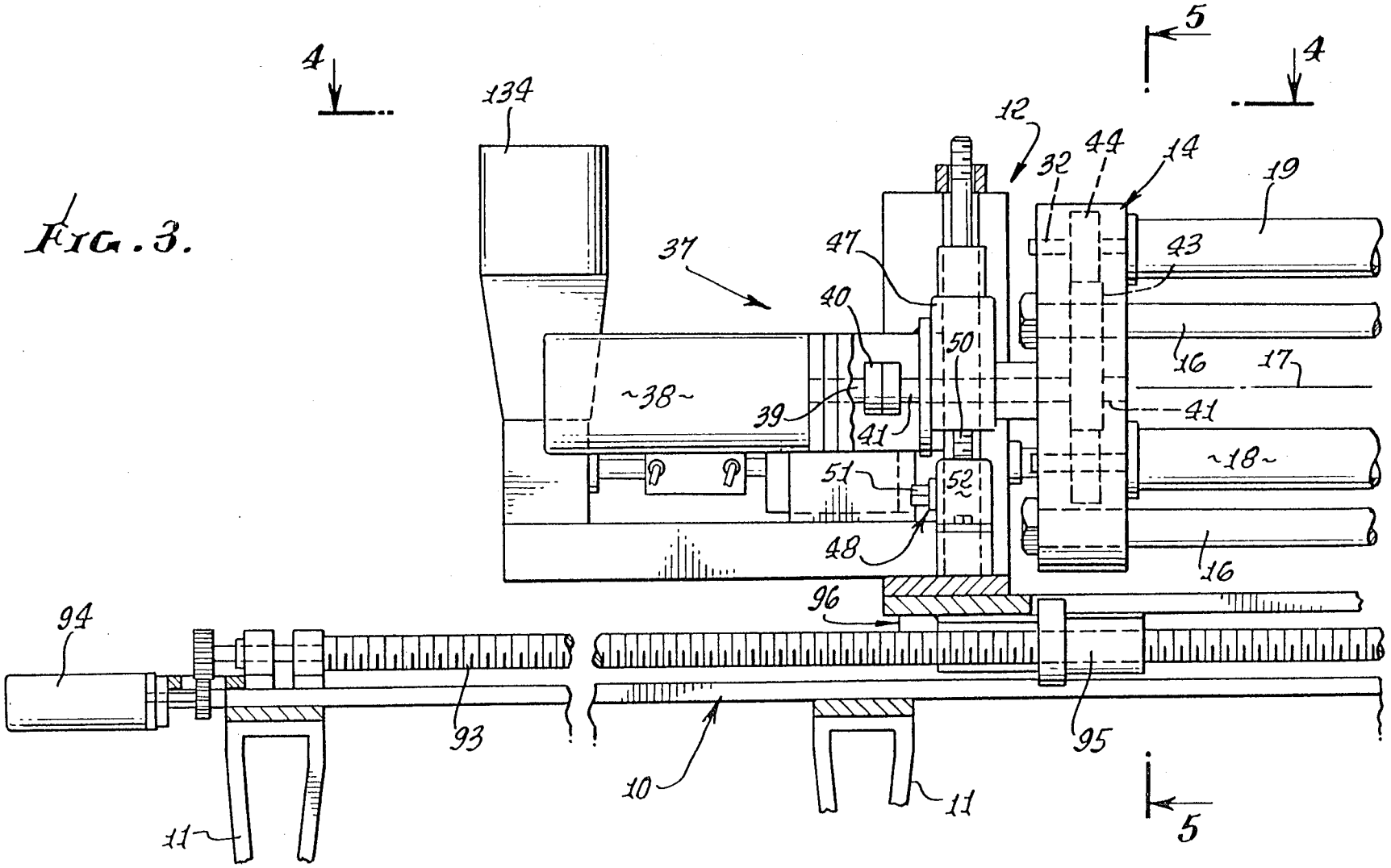
FIG. 3 is an enlarged fragmentary elevation taken in section lines 3—3 of FIG. 1*a;*

Referring first to FIGS. 1*b*, 2*a*, 2*b*, 3–5, 8 and 13, the brush filling apparatus is seen to include a base 10 supported by legs 11, longitudinally spaced upright frames 12 and 13 carried by the base, and longitudinally spaced rotary heads 14 and 15 carried by the respective frames 12 and 13. The heads are horizontally axially spaced apart, and axially elongated supports in the form of rods interconnect the heads to rotate therewith. For example, three such rods 16 may be spaced at equal intervals about the head axis 17 of rotation, as is clear from FIG. 8. Accordingly, as head 15 is rotated about axis 17, it transmits such rotation to the head 14, via such rods. An auxiliary and axially adjustable head 15*a* is carried on the rods between heads 14 and 15 to rotate therewith, for purposes as will appear.

First means is provided to releasably couple three longitudinally spaced brush cores 18, 19 and 20 to the heads, as for example to heads 14 and 15*a*, with the cores spaced about axis 17. Such means is indicated generaly at 21 in FIG. 6 for coupling the left ends of the cores to the head 14, and at 22 in FIG. 14 for coupling the right ends of the cores to auxiliary head 15*a* The cores are typically spaced at equal angular intervals between the rods 16, as is clear from FIG. 8.

Figure 8:
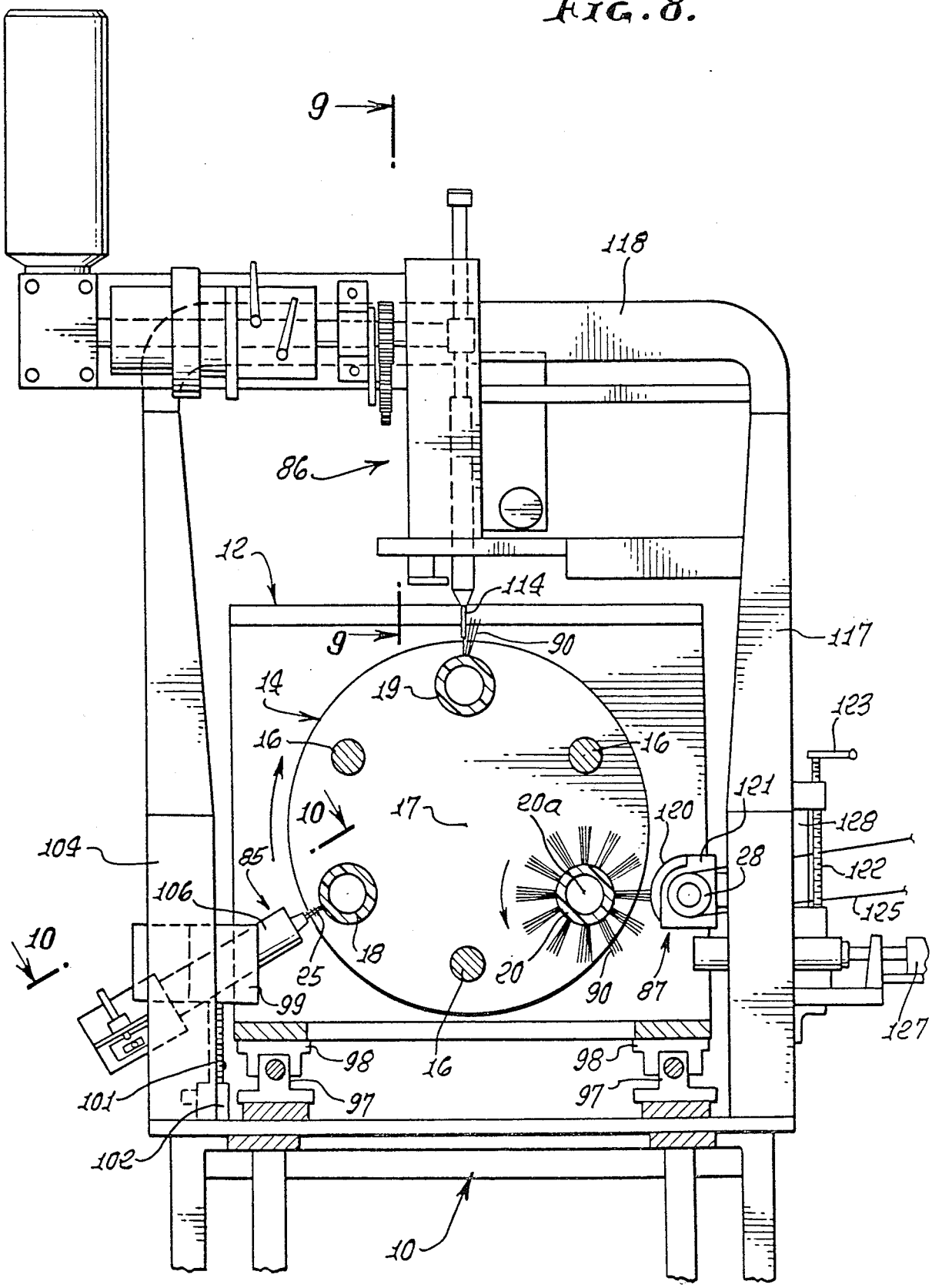
FIG. 8 is an enlarged sectional elevation taken on lines 8—8 of FIG. 1*a;*

Second means is provided to rotate at least one of the heads about the central axis 17, thereby to rotate the other heads, the rods and the cores between three index positions. Such positions are shown in FIG. 8 as a first index position at which holes are drilled in the core at that position, as by third means including drill 25 directed toward the side of the core 18, the drill driven by a motor 26; a second index position at which bristles 90 are filled into the drilled holes, as by fourth means 86 including fill tip 114; and a third index position at which filled-in bristles 90 projecting from the core are trimmed, as by fifth means 87 including rotary cutter 120 and rotary drive 28 therefor. Also, core 20 may be independently rotated, about its axis 20*a* during the trimming operation, while heads 14, 15 and 15*a* are not rotated, so that all projecting bristles are trimmed to the same length. Such trimming may be effected while holes are being drilled in core 18, and bristles are being filled into the holes in core 19. Thus, these operations are carried out, and on successive cores, each time the heads are rotated to a "next" index position; and before each such rotation, the filled and trimmed core at position 20 is removed, and a new core inserted, so that upon rotary indexing, the new core will be carried to position 18 for drilling.

SPECIFIC DESCRIPTION

Figure 6:
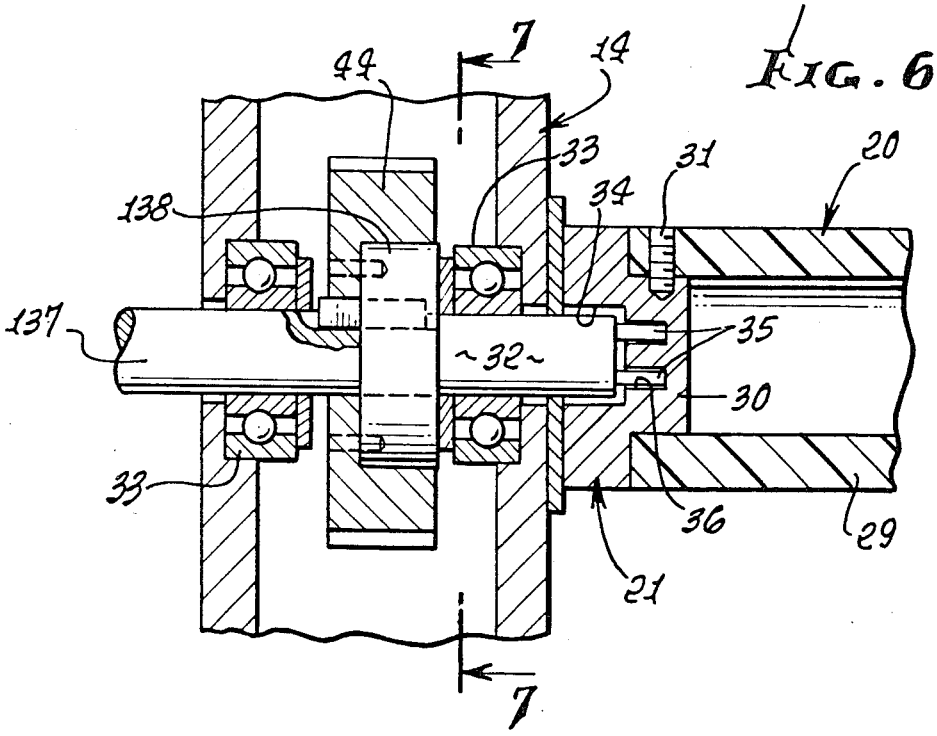
FIG. 6 is an enlarged section taken in elevation on lines 6—6 of FIG. 5.

Referring to FIG. 6, each core 18-20, is shown to include a cylindrical body 29, having a plug 30 temporarily retained to one (left) end of the body as by a set screw 31. Plug 30 is coupled to the head via a rotary shaft 32 supported by the rotary head 14, as via bearings 33. The rightward end of the shaft penetrates a recess 34 in the plug, and pins 35 protrude from the end of the shaft into drilled openings 36 in the plug. Accordingly, as the head 14 rotates about axis 17, the core is also rotated about that axis; and as the shaft 32 is independently rotated at an index position (see FIG. 8) the core is rotated. See for example the drive mechanism 37 in FIGS. 3-6, including drive motor 38 having output shaft 39, the latter coupled at 40 to shaft 41 extending to head 14; spur gear 42 on shaft 41, in head 14; and spur gear 43 in the head meshing with gears 42 and with driven gears 44 on shafts 32. Gears 43 are carried by shafts 46 in the head. Motor 38 is carried by a block or support member 47 mounted on a jack screw mechanism 48 by the frame 12; thus, block 47 has threaded connection with vertical screw 50, the head 14 also carried by that block. Screw 50 is rotatable by a nut 51 and gear box 52, both carried by frame 12. Accordingly, the cores 18-20 can be lifted and lowered, at their left ends, and relative to the mechanism for filling bristles into the uppermost core 19 in FIG. 8, whereby bristles of selected length can be filled into the core.

Figure 15:
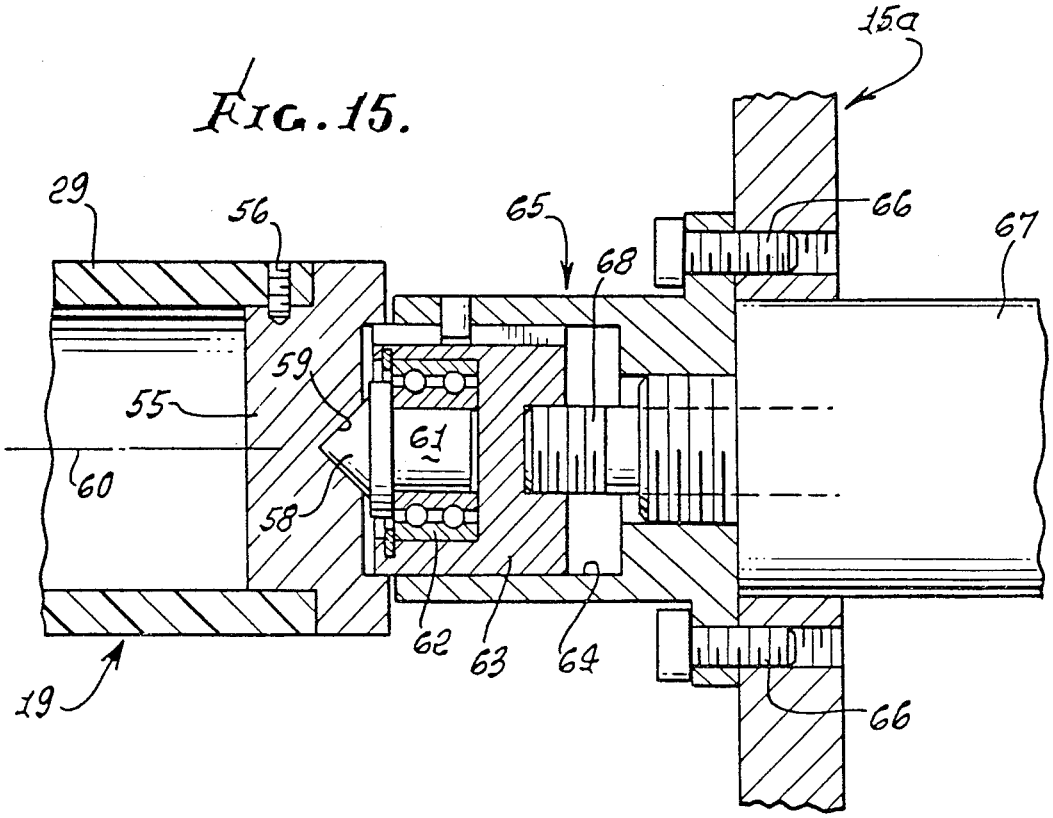
FIG. 15 is an enlarged plan view taken in section on lines 15—15 of FIG. 14.
Figure 14:
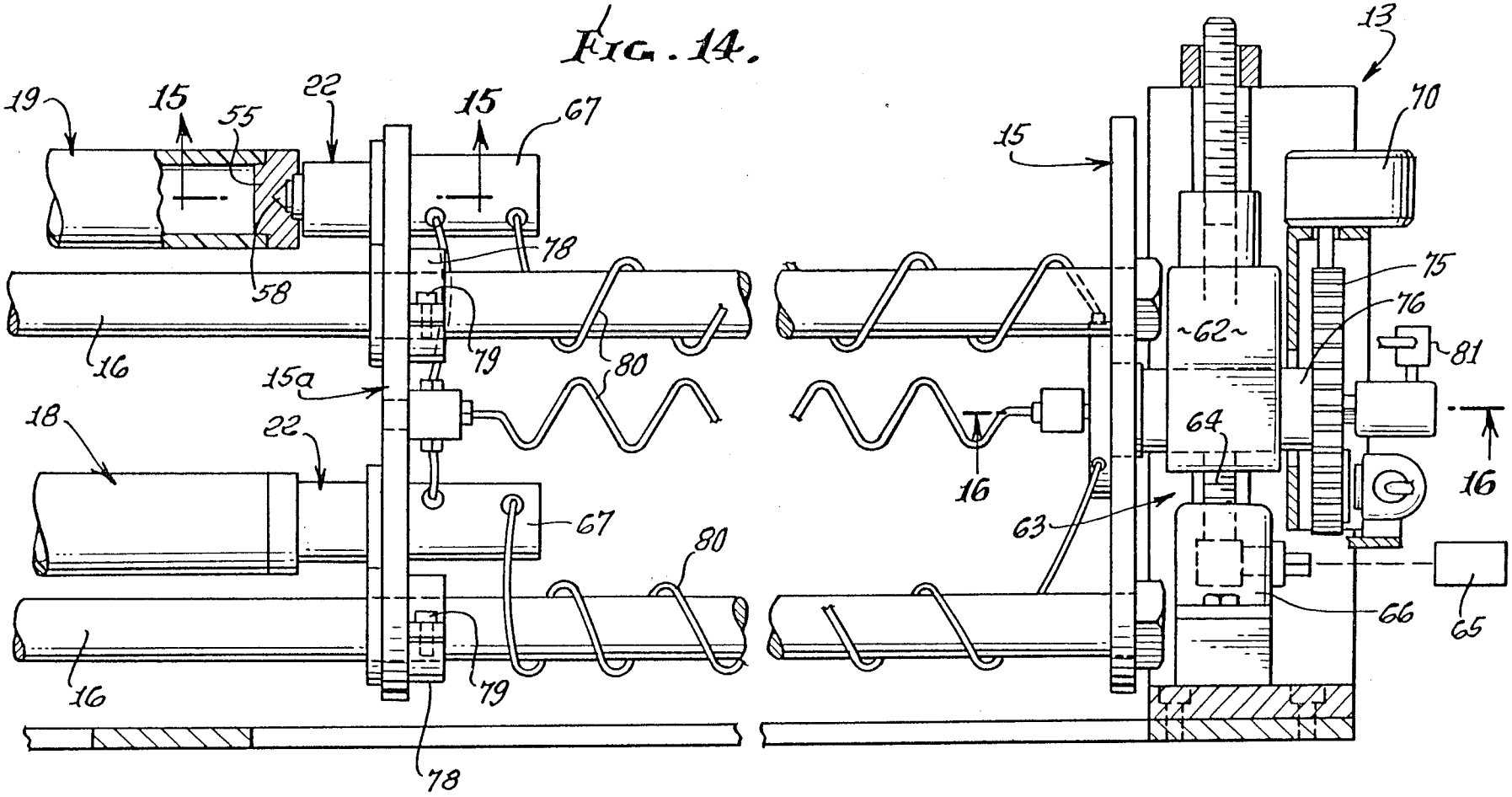
FIG. 14 is an enlarged fragmentary side elevation taken on lines 14—14 of FIG. 13.

Referring to FIGS. 14 and 15, each core body 29 has a plug 55 temporarily retained to the other (right) end of the body, as by a set screw 56. Plug 55 is coupled to the rotary head 15*a* to allow core rotation relative to that head (as described above) and for rotation with that head, via rotary drive transmitted as by rods 16, explained above. For this purpose a conical insert 58 is removably receivable into a conical recess 59 located in the plug 55, in alignment with the core axis 60. Insert 58 is carried by a shaft 61 rotatably mounted as by bearings 62 carried by an axially shiftable plug 63. The latter is shiftable axially in the bore 64 of a carrier 65 attached to head 15*a*, as by fasteners 66. Ac actuator 67 also carried by the head has a shaft 68 connected to plug 63, to controllably shift it leftwardly and rightwardly. When core connection to head 15*a* is desired, its left end is first releasably connected to head 14 as described above. The rightward end of the core is then aligned with tapered insert 58 which is in retracted (rightward) position. The actuator is then operated to insert the plug into tapered recess 59. A master control 100, such as may include a programmable computer, (see FIG. 1*a*) has controls to operate the motors and actuators described herein, as by appropriate connections therewith.

Figure 13:
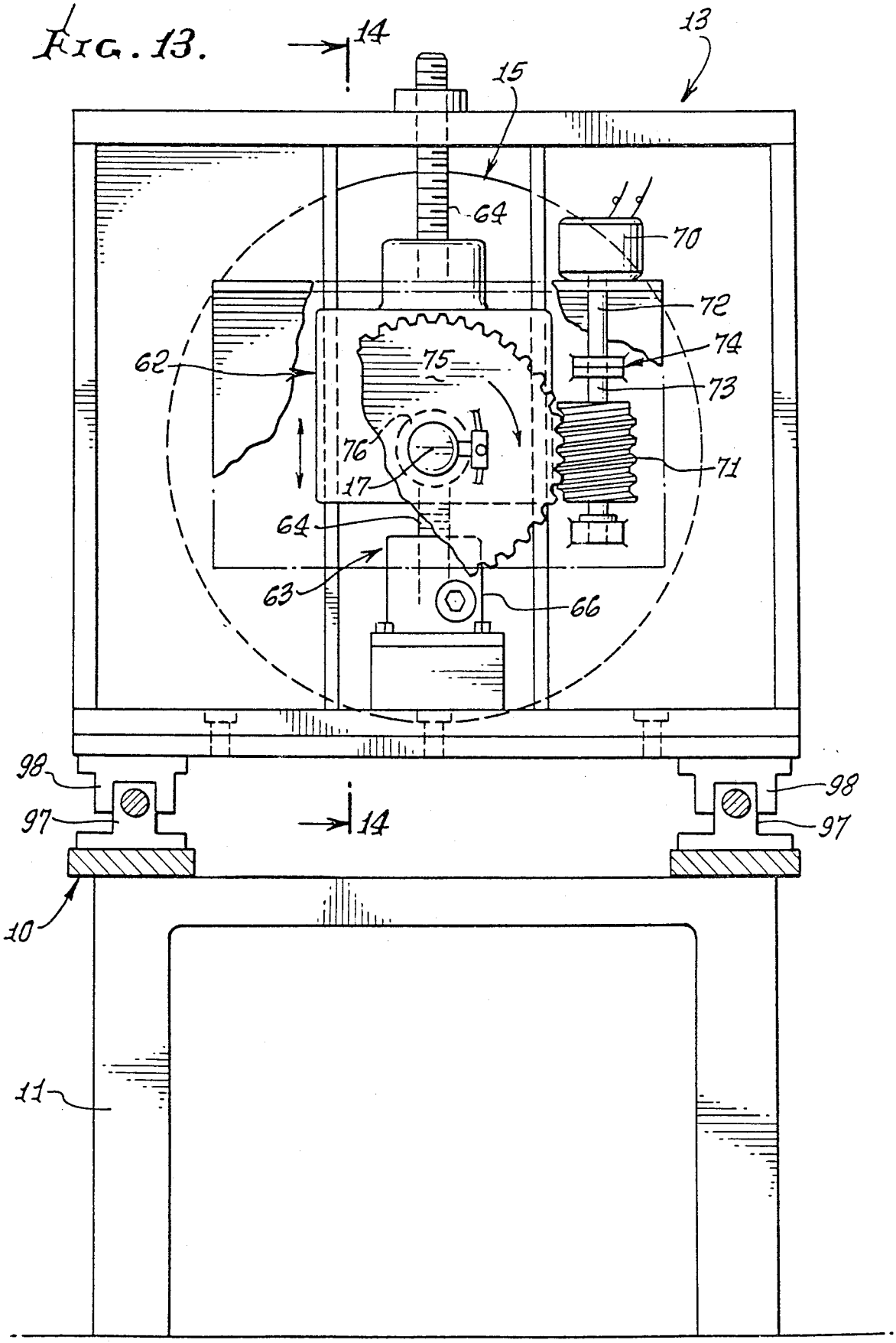
FIG. 13 is an enlarged vertical section taken on lines 13—13 of FIG. 1*b;*

Lifting and lowering (lateral displacement) of the rightward ends of the core 18-20 is achieved via the head 15*a*, the rods 16 that support that head, and the head 15 to which the rods are connected, as shown in FIGS. 13 and 14. Head 15 is carried by a block (support member) 62 mounted on a jack screw mechanism 63; thus, block 62 has threaded connection with vertical screw 64. The latter is rotatable by a drive including motor 65 and gear box 66, both carried by frame 13. Accordingly, the cores 18-20 can be lifted and lowered, at their right ends, and in synchronism with their left ends (through master control 100) and relative to the mechanism for filling bristles into the uppermost core 19, for purposes referred to, and to be later described.

Means is also provided to rotate at least one of the heads about their common axis 17, so as to achieve core rotation between and into three index positions, as shown in FIG. 8. FIG. 13, shows one such means to include a step motor 70, a worm 71 coupled to step motor 70 by shafts 72, 73 and coupling 74; a large diameter spur gear 75 coupled to the worm, to be controllably driven about axis 17; and a shaft 76 interconnecting gear 75 and head 15 to rotate the latter about axis 17. Shaft 76 is carried by block 62, as shown in FIG. 14.

Longer cores 18-20 can be accomodated between heads 14 and 15*a* by moving head 15*a* rightwardly on rods 16, in FIG. 14, and shorter cores can be accomodated by moving head 15*a* leftwardly on the ends. At selected positions, the head 15*a* can be attached to the rods, as by means of a clamp 78, integral with the head 15*a*, and through which a rod 16 passes. A fastener 79 is tightenable to lock the clamp to the rod. The actuators 67 are also shown in FIG. 14 as pneumatically operated, with air pressure lines 80 extending about the rods to accomodate head 15*a* movement on the ends, left or right. A single source 81 of air pressure supplies all the lines 80, and is valve controlled, via master control 100.

BRISTLE FILLING AND TRIMMING

Referring now to FIG. 8, the following are generally indicated:

third means, as at 85 for example, to drill bristle receiving holes in a core 18 at one of the core rotary index positions, as shown;

fourth means, as at 86 for example, to fill and affix bristles 90 into such drilled holes in core 19 at another of the core rotary index positions; and fifth means, as at 87 for example, to trim bristles 90 that project outwardly from holes into which the bristles have been affixed, in core 20, at a third of the core rotary index positions. As explained above, after bristle trimming, the core 20 is removed from the apparatus, and a new and undrilled core is inserted into position 20, for subsequent indexing to station positions indicated by cores 18 and 19.

Figure 10:
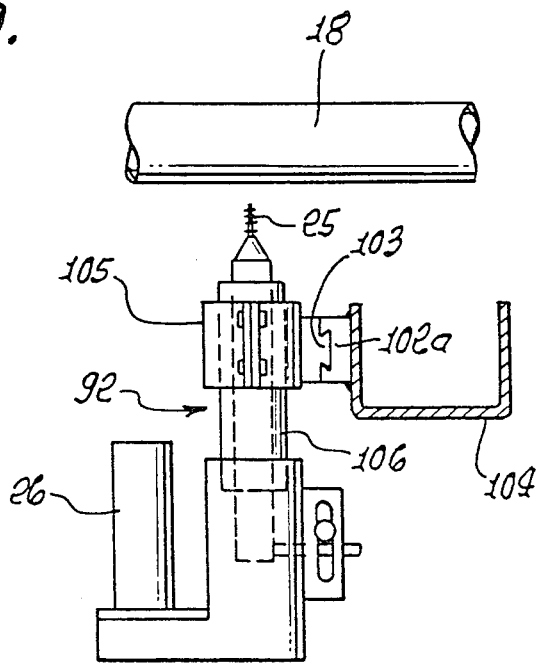
FIG. 10 is an enlarged section taken on lines 10—10 of FIG. 8.

As shown in FIGS. 8 and 10, a drill 25 is rotated by a motor 92, and also suitably advanced and retracted as by actuator 106, generally radially relative to a core 18, to drill a hole in core 18. Multiple holes are drilled at circumferential and axial intervals, due to controlled rotation of the core (as by gearing shown in FIG. 5) and controlled axial movement of the core, relative to the drill. Such axial movement is effected as by rotation of a lead screw 93 by servo motor 94, indicated for example in FIG. 3. As screw 93 rotates, it progressively axially displaces a nut 95 to which frame 12 is connected at 96. See also FIG. 5. Frame 12 is supported on rails 97 extending axially on base 10, as via slippers 98 attached to the frame 12. Frame 13 is similarly supported on rails 97, to slide axially along in response to frame 12 axial movement, due to rod 16 interconnection of the frames 12 and 13. Thus, the cores 18-20 are accurately movable axially relative to the third, fourth and fifth means, and to enable drilling of holes as in core 18 at accurately spaced axial intervals, and to enable positioning of the holes in alignment with the bristle filling means 86.

The drill actuator and motor unit 92 is supported by a nut 99 on vertical jack screw shaft 101 rotated by manual adjustment or motor 102. This enables the drill to remain in radial alignment with core 18, despite lifting and lowering of the frames and heads, as previously described. See also guiding and relatively slidable tongue and groove parts 102*a* and 103, part 102*a* on frame member 104, and part 103 on a clamp 105 attached to the actuator housing 106.

Figure 9:
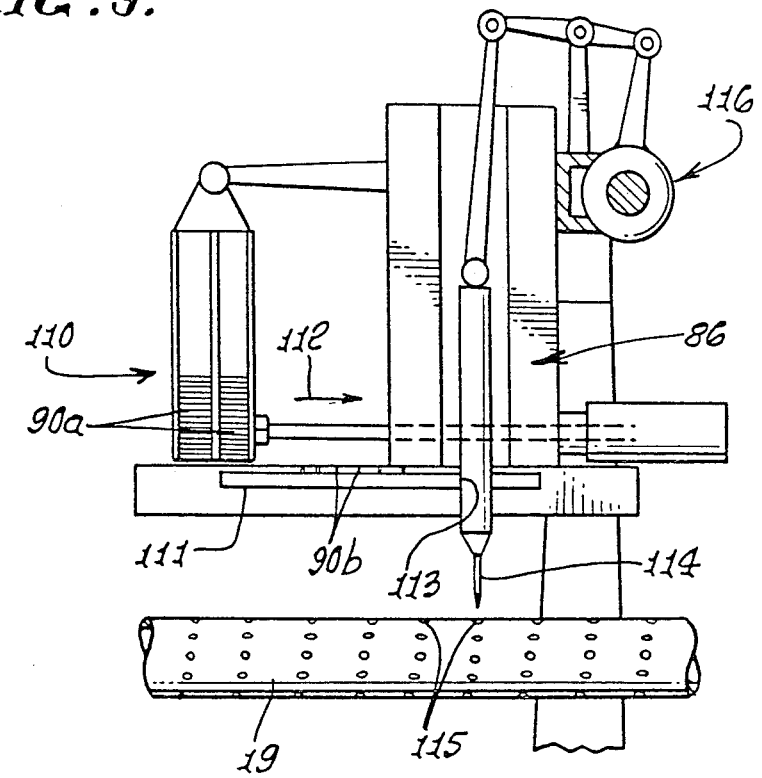
FIG. 9 is an enlarged sectional elevation taken on lines 9—9 of FIG. 8.

The bristle fill means 86 is shown in FIGS. 8 and 9 as including a bristle feeder 110 from which stacked bristles 90*a* are fed onto a tray 111. They are then suitably advanced rightwardly (see arrow 112, and bristles 90*b*) until they overlap an opening 113 in the tray. A vertically operable plunger 114 displaces groups of bristles downwardly, in V-shape, into a pre-drilled hole 115 in the core 19, and affixes them as for example via a staple fed to the tip of the plunger. Other affixing means may be employed. Mechanism to move the plunger up and down is indicated generally at 116. Bristle feeding and filling aparatus of the general type is known, as for example is described in U.S. Pat. No. 2,689,152. Arbor structure including frame parts 104 and 117, and cross piece 118, support the mechanism 86.

Figure 11:
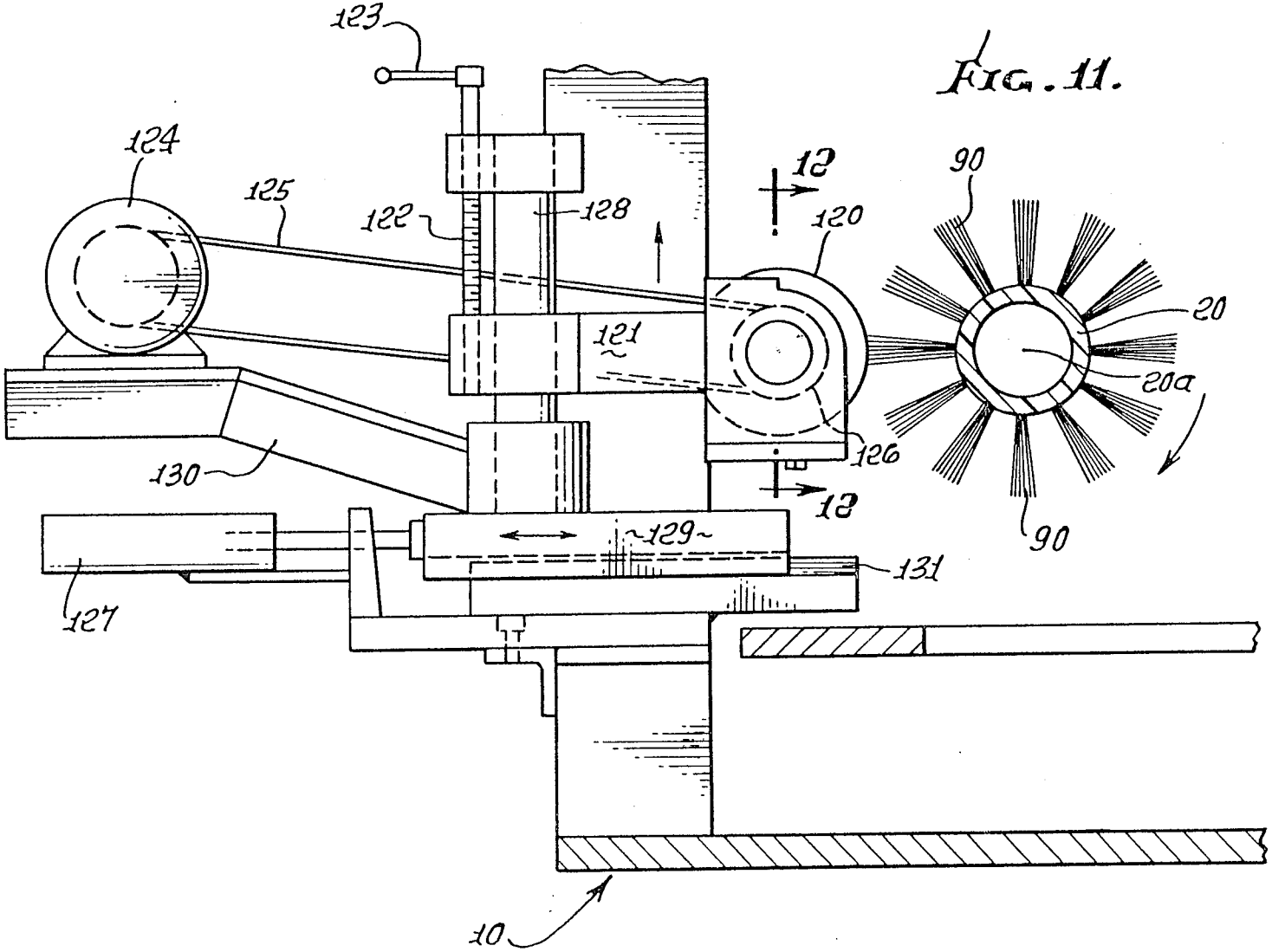
FIG. 11 is an enlarged section taken in elevation on lines 11—11 of FIG. 1*a;*
Figure 12:
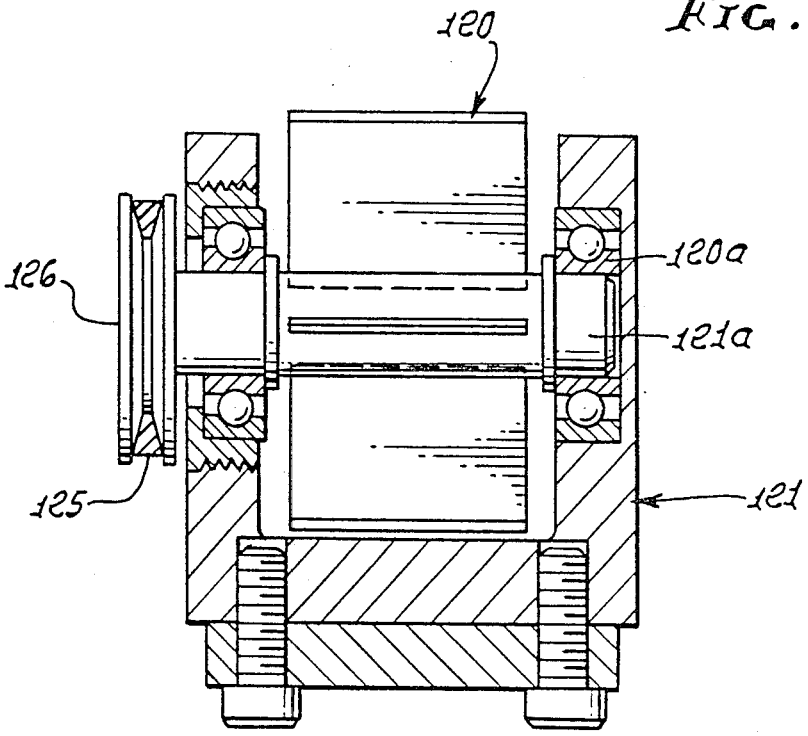
FIG. 12 is an enlarged fragmentary section taken on lines 12—12 of FIG. 11.

The bristle trimming means 87 is shown in FIGS. 8 and 11 to include a rotary cutter 120, supported for rotation on bracket 121. The latter may be moved up and down by rotation of a lead screw 122, as by handle 123, the screw carried by post 128 which also carries bracket 121. A motor 124 drives the cutter as by a belt 125 entrained on a hub 126 associated with the cutter. In addition, the cutter may be moved towards and away from the bristles, as by an actuator 127 connected with a support 129 for the post 128 and motor carriage 130. A guideway 131 guides in and out movement of the support 129. Accordingly, bristles may be trimmed to selected lengths, and up and down movement of the heads and frames is enabled. See also cutter shaft 121*a* bearing supported at 120*a*.

Figure 4:
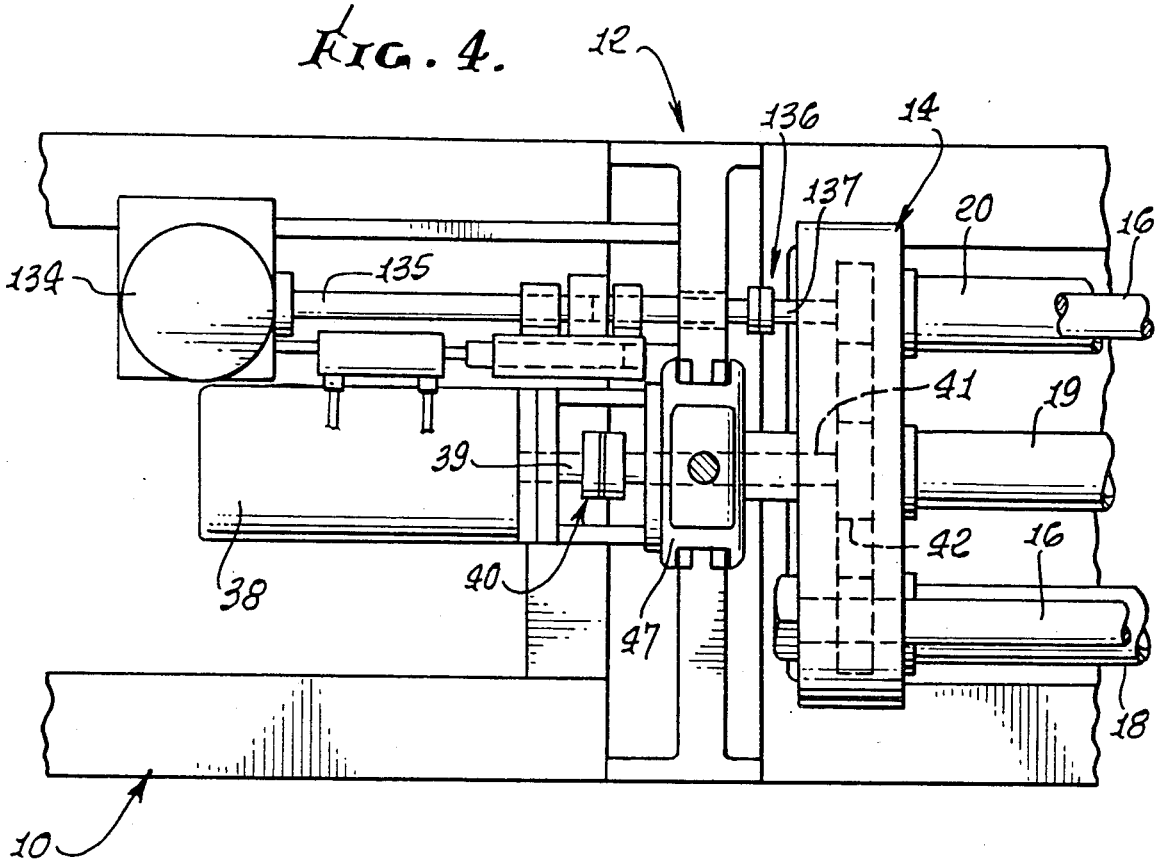
FIG. 4 is an enlarged fragmentary plan view taken on lines 4—4 of FIG. 3.

Referring back to FIGS. 5-7, indexing rotation of the cores 18-20 is provided for by the above described gearing, servo motor 38 providing such indexing input, whereby accurate rotary location of the holes and bristle feed to the holes is achieved. In addition, core 20 may be independently rapidly and continuously rotated, so that bristles may be trimmed, as described. Means to rotate the core 20 is shown in FIG. 4 to include a drive motor 134, drive shaft 135, releasable external coupling 136, dirve shaft 137, and clutch 138 connectible to core rotating shaft 32 via a clutch 138 (three such clutches are provided, one for each shaft 32). When coupling 136 is made up, after rotary indexing of the cores and rods and heads to a position as shown in FIG. 8, rapid and continuous rotary drive is transmitted from motor 134 through coupling 136 and override clutch 138 to shaft 32 and core 20 in trim position. Such rotation is transmitted in direction 140, in FIG. 7, overriding the coupling of gear 44 to the shaft 32. When drive is transmitted from gear 44 to shaft 32 in position 18 and 19 of the cores (in FIG. 8) the clutch parts (see ball 142 and dog 143) transmit such torque to the shaft 32, in rotary direction 144.

Figure 16:
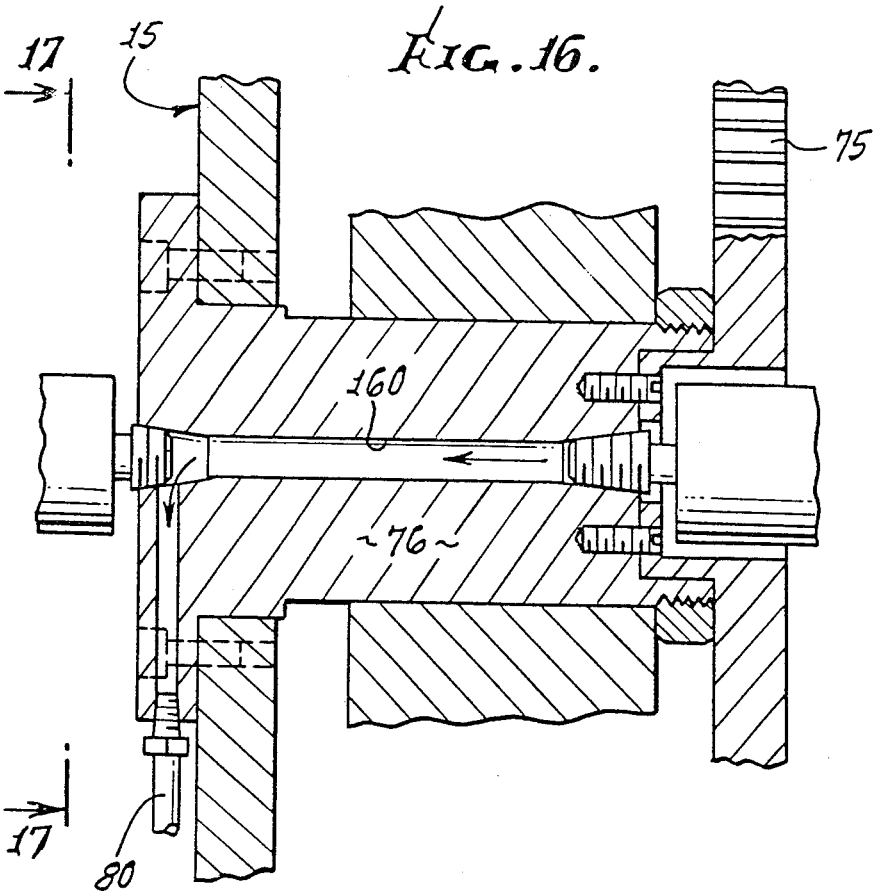
FIG. 16 is an enlarged plan view taken in section on lines 16—16 of FIG. 14.
Figure 17:
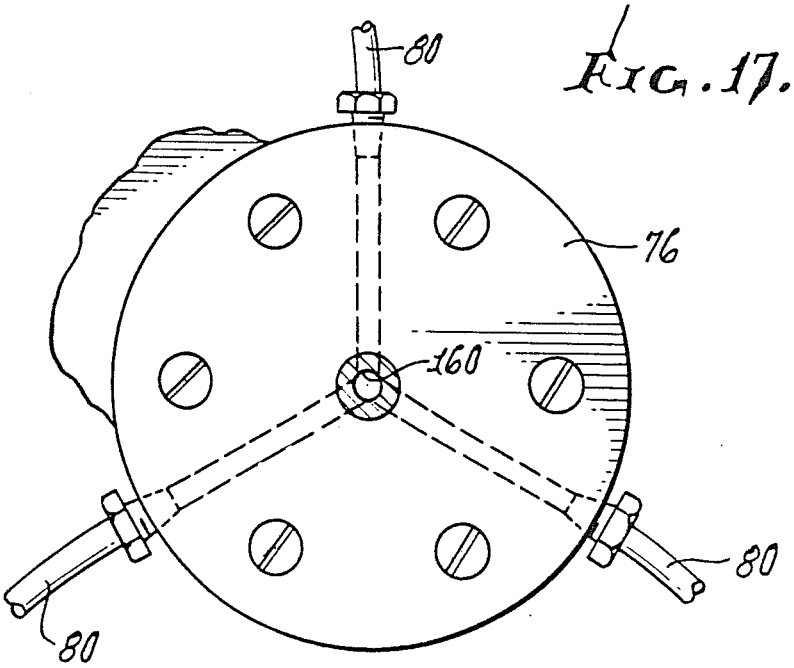
FIG. 17 is an enlarged side elevation taken on lines 17—17 of FIG. 16.

FIGS. 16 and 17 show pneumatic air pressure supply to lines 80 via porting 160 in shaft 76.

Figure 18:
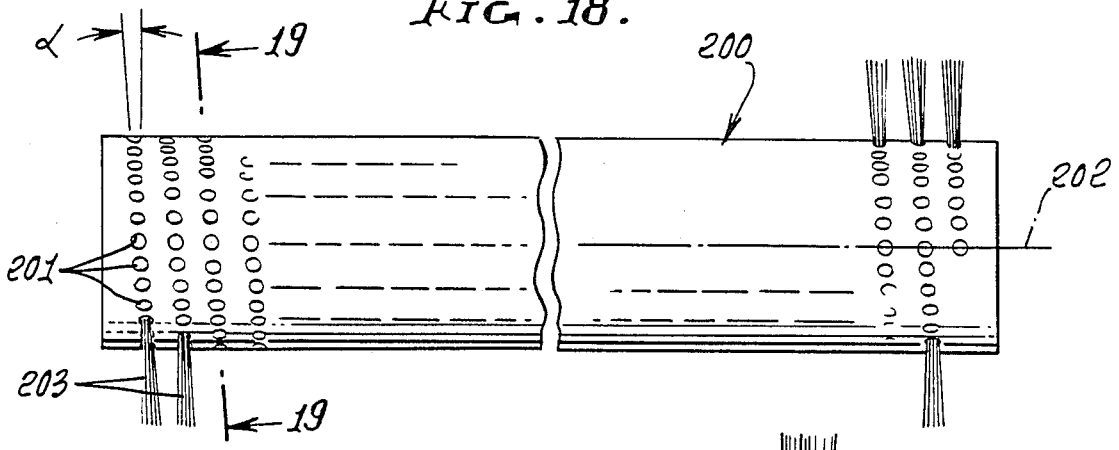
FIG. 18 is a front elevation showing a brush produced by the process and application of the invention.
Figure 19:
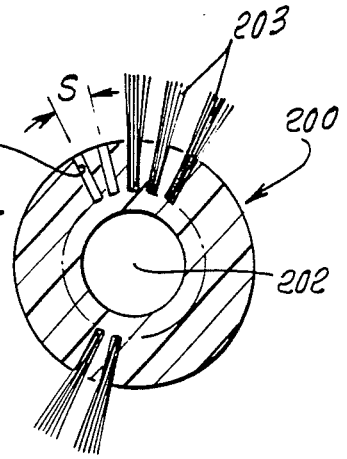
FIG. 19 is a section on lines 19—19 of FIG. 18.
Figure 20:
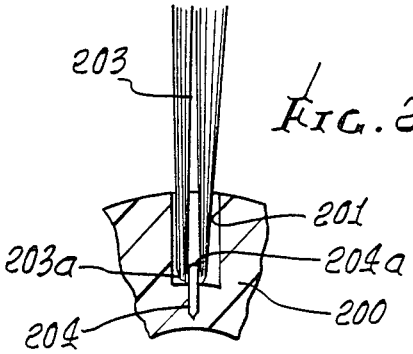
FIG. 20 is an enlarged fragmentary section showing anchoring of bristles in a core hole.

FIGS. 18-20 illustrate a brush core 200 to be filled with bristles, by the process of operation of the FIGS. 1-17 apparatus, for example. The core is cylindrical and axially elongated, and typically consists of tough, durable, synthetic resin.

Hole 201 are formed in the core, as by drilling employing the above described process. The holes extend from the core outer surface in an inward direction, to form a pre-selected pattern about and along the core, as controlled by the computer 100. For example, the holes may extend in a spiral pattern about the core axis 202 and lengthwise of the core as well as at equal spacings "s". The process enables very accurate selection or control of such spacing "s", as well as of the angle "$\alpha$", of the spiral, to provide brushes with a very wide range of such dimension. Bristles are shown filled into the cores, at 203; and densely filled brushes may be so produced with at least about 25 spiral convolutions of holes (and bristles) per axial foot along the core length. The cores of such brushes may range from $1\frac{1}{2}$ to 4 inches in diameter, for example.

FIG. 20 shows a bristle group 203 filled into a hole, with a retainer, such as a staple 204, holding or anchoring the bristles in position. For this purpose, the bristles may have U-shaped portions 203*a* at the bottom of the hole. The staple has a cross-piece 204*a* extending over the bristle U-shaped bristle portion 203*a;* and the staple has stems penetrating downwardly into the core material. The process of filling the bristles into the holes and anchoring them proceeds in accordance with the description of FIGS. 1-17.

Figure 21:
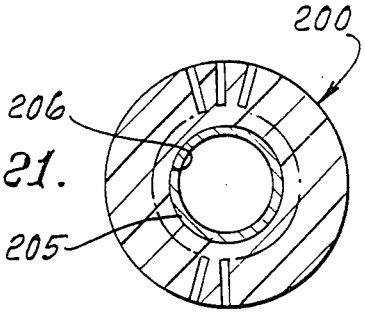
FIG. 21 is a section like FIG. 19, showing a modification.

FIG. 21 shows core 200 into which a metallic shaft extends axially, for support. The shaft is shown in the form of steel tube 205 engaging and supporting the bore 206 of the plastic core, whereby much longer length cores and brushes are made feasible, without undesirable bending. In use metallic staples employed to anchor the bristles may have their penetrating ends turned or deflected by the steel tube, to add to their resistance to pull-out.

Figure 22:
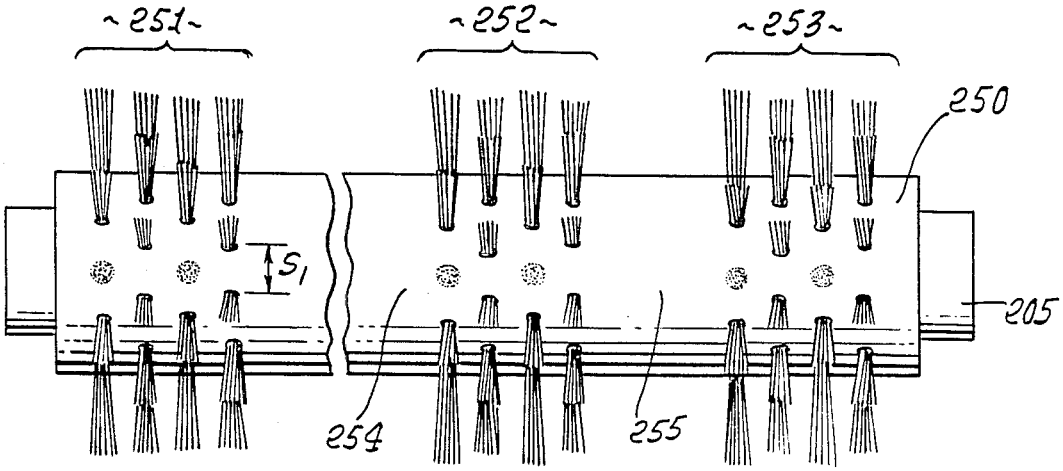
FIG. 22 is a view like FIG. 18, showing a modified brush.

FIG. 22 shows a modified synthetic resin core 250 supported on a metallic tube 205. The hole formation, and bristle filling, under control of the computer 100, are carried out to form multiple clusters of bristles, indicated for example at 251-253, the clusters separated lengthwise of the core. (See gaps at 254 and 255). Note the larger gaps or spaces "$s_1$", between successive holes and bristles therein. Operation of the control 100 enables a wide range of hole group or cluster positions, and spacings between holes in each group. Also, the process enable use of different type bristles on the same core, as for example steel, natural fiber, and synthetic fiber; and different colored bristles may also be employed. For example, each of the bristle cluster 251-253 may have different colors.

Accordingly, during forming of the holes in a core, the hole spacing and spiral angularity (about axis 202) may be easily changed or selected, through use of the process.

We claim:

1. In a brush filling process employing longitudinally axially spaced rotary heads defining an axis of rotation, and brush cores, the steps that include:

(a) releasably coupling each of three of said brush cores to two of the heads, with the cores spaced about the said axis, (b) rotating at least one of the heads about said axis, thereby rotating the cores between three index positions, (c) forming bristle receiving holes in a core at one of said positions, (d) controllably and interruptedly rotating the core at a second of said positions, and filling bristles into the holes in the core at said second position thereby defining filled bristles projecting from said holes, (e) trimming the filled bristles outwardly of the holes in a core that is rotating at a third of said positions, and coupling a drive through a particular head after stopping said rotation of all of the heads about said axis of rotation, thereby independently transmitting rotation to the core at said third position while keeping said particular head in fixed, non-rotating position, (f) said cores consisting of synthetic resin, (g) each core being annularly elongated, and including stapling the bristles to the core, within said holes, at said second position, by employing staples which are introduced into said holes after portions of the bristles are filled into the holes.

2. The process of claim 1 including effecting said transmitting of rotation through the particular head at a location offset from said axis of rotation defined by the heads.

3. The process of claim 1 including forming said forming of holes is carried out to define a sequence of holes spiraling about said axis, lengthwise of the core.

4. The process of claim 3 wherein said sequence of holes is defined by forming at least about 25 spiral convolutions of holes per axial foot.

5. The process of claim 1 including selecting said bristles from the group consisting of (i) steel (ii) natural fiber (iii) synthetic fiber.

6. The process of claim 5 including controlling said (d) step, thereby filling different bristles of different characteristics in said holes.

7. The process of claim 6 including forming said bristles to have different colors.

8. The process of claim 6 including forming said bristles to have different compositions.

9. The process of claim 6 wherein said controlling is carried out by forming multiple clusters of bristles, the clusters being separated lengthwise on the core.

10. The process of claim 1 including controlling said (b) and (c) steps, thereby selectively locating the holes, in an irregular pattern.

11. The process of claim 1 including effecting relative axial movement between said rotary heads, and said positions.

12. The process of claim 1 including effecting relative lateral movement between said cores and heads.

13. The process of claim 1 wherein the core is annular and elongated, and including providing a steel tube in the core in supporting relation with the core bore.

14. The process of claim 13 including driving staples into the core to retain the bristles to the core, the holes, and causing the staple terminals to be deflected by said steel tube.

15. The process of claim 1 including providing first through fifth means for respectively effecting said (a)-(e) steps.

16. The process of claim 15 imcluding supporting said rotary heads and said third, fourth and fifth means to effect relative axial movement between said rotary heads, and said third, fourth and fifth means.

17. The provess of claim 15 including effecting relative lateral movement between siad cores and heads, and said fourth means.

18. The process of claim 17 including providing structure effecting said relative lateral movement, said structure including jack screws associated with the heads between which elongated connecting rods extend, elevating and lowering said heads and rods relative to said fourth means which fill bristles substantially vertically into core holes, at said second position.

19. The process of claim 18 including elevating and lowering said third means in correspondence to elevation and lowering of a core to be drilled as effected by said jack screw elevation and lowering of said heads and rods.

20. The process of claim 17 wherein said structure includes supports for said rotary heads that include first and second support members which are relatively laterally movable, and providing drives connected with said support members and operating said drives, thereby controllably moving said support members, laterally.

21. The process of claim 20 including providing a base, and frame members on the base supporting said support members and said drives.

22. The process of claim 21 including providing an axially longitudinally extending screw operatively connected with at least one of said frame members and operating said screw, thereby controllably shifting said frame members axially, and relative to said third through fifth means.

23. The process of claim 15 including providing elongated rods, and wherein said heads include first and second heads interconnected by said elongated rods, and an auxiliary head supported on said rods between said first and second heads, said first means carried by said first and auxiliary heads.

24. The process of claim 23 including moving said auxiliary head lengthwise on said rods and relative to said first and second heads, thereby accommodating connection of different length cores to the first and auxiliary heads, via couplings.

25. The process of claim 15 including providing control means to controllably rotate the core, and operating said control means, thereby rotating the core in siad first position.

26. The process of claim 25 including operating the control means, thereby controllably rotating the core in said second position, and in synchronism with rotation of the core in said first position.

27. The process of claim 15 including providing a drive and operating sixth means to continuously rotate the core in said third position.

28. The process of claim 27 wherein said sixth means includes a drive operatively coupled through one of the heads to the core at siad third position, and providing said drive with a deactivated position wherein rotation of said one head is made possible.

29. Apparatus of claim 28 including effecting relative lateral movement between said third and fifth means, and said fourth means, thereby accommodating different diameter cores.

30. The process of claim 28 including simultaneously rotating the cores at said first and second positions and relative to the heads, thereby drilling said holes at circularly spaced locations, and filling bristles into said holes.

31. The process of claim 15 including rotating said heads between said rotary index positions.

32. The process of claim 31 wherein the rotary heads are horizontally axially spaced apart, and including providing axially elongated supports interconnecting the heads, to rotate therewith.

33. The process of claim 17 including providing drives for driving said second through fifth means, and providing and operating a master control for controlling said drives.

34. In a brush filling process filling bristles into cores which are cylindrical and axially longitudinally elongated, and employing rotary heads and rod means including rods, the steps including:

(a) locating three of the rotary heads to be longitudinally spaced and positioned to have a common axis of rotation, one of the heads being axially adjustable relative to the other two, and locating said rod means including said rods to interconnect said other two heads, so that said one head is axially adjustable along the rods, (b) releasably and simultaneously coupling each of three of the cores to two of the heads, which include said one head and with the cores spaced about the axis, and extending in axially parallel relation, (c) rotating at least one of the heads about said common axis, thereby bodily rotating the three heads and three cores between three index positions, with each core maintaining its original axial orientation in each index position, (d) drilling bristle receiving holes in a core that is stationary at a first one of said positions, (e) filling bristles into the holes in a core at a second of said positions, and while that core is stationary, (f) trimming the bristles filled into the holes in a core, at a third of said positions, and while that core is rotating, (g) simultaneously rotating the cores at said first and second positions and relative to the heads, so that holes are drilled at circularly spaced locations, and bristles are filled into said holes, (h) said common axis of rotation being a generally horizontal axis, about which all of said heads rotate between said rotary index positions, and including maintaining the rotary heads horizontally axially spaced apart, said rod means including axially elongated supports interconnecting the heads, to rotate therewith, (i) said other heads including first and second heads interconnected by said elongated rods, and said one head comprising an auxiliary head which is located to be supported on said rods between said first and second heads, and moving said auxiliary head generally horizontally lengthwise on said rods and relative to said first and second heads, thereby accommodating connection of different length cores to the first and auxiliary heads, via couplings defined by said first means, (j) and continuously rotating the core in said third position by transmitting drive through one of the other two heads to the core at said third position, and thereafter deactivating said drive so that rotation of said one of the other two heads is then made possible.

* * * * *